United States Patent [19]

Roberts

[11] 3,993,805

[45] Nov. 23, 1976

[54] METHOD OF APPLYING LIQUID FINISH COMPOSITION TO FILAMENTS

[75] Inventor: John S. Roberts, Ellicott City, Md.

[73] Assignee: Concorde Fibers Inc., Columbia, Md.

[22] Filed: May 17, 1974

[21] Appl. No.: 470,771

Related U.S. Application Data

[63] Continuation of Ser. No. 276,617, July 31, 1972, abandoned.

[52] U.S. Cl. ..... 427/175; 427/211; 427/428; 118/223; 118/234; 28/75 R; 28/75 WT

[51] Int. Cl.[2] ..... B05D 1/28; D06B 3/04

[58] Field of Search ..... 117/7, 138.8 E; 28/75 R, 72.6, 75 WT; 427/172, 175, 211, 428; 118/223, 234

[56] References Cited

UNITED STATES PATENTS

| | | | |
|---|---|---|---|
| 1,133,322 | 3/1915 | Seiberling | 117/7 X |
| 1,777,457 | 10/1930 | Wilson | 118/223 |
| 2,040,105 | 5/1936 | Ritzert | 117/7 |
| 2,272,588 | 2/1942 | Simison | 117/126 GQ |
| 2,514,187 | 7/1950 | Bosomworth | 117/7 |
| 2,728,972 | 1/1956 | Drummond et al. | 27/75 R X |
| 2,846,752 | 8/1958 | Lessig | 28/75 R X |
| 2,861,393 | 11/1958 | Whitehurst et al. | 117/7 X |
| 2,934,400 | 4/1960 | Siggel et al. | 117/7 |
| 3,044,891 | 7/1962 | Lauchenauer et al. | 117/7 |
| 3,050,820 | 8/1962 | Pamm | 117/7 X |
| 3,113,369 | 12/1963 | Barrett et al. | 28/75 R |
| 3,143,405 | 8/1964 | Wong | 28/75 R X |
| 3,155,122 | 11/1964 | Grant | 117/126 GM |
| 3,157,536 | 11/1964 | Caines | 118/234 |
| 3,167,468 | 1/1965 | Lovelace et al. | 28/75 R X |
| 3,194,210 | 7/1965 | Harris | 118/234 |
| 3,228,791 | 1/1966 | Armour et al. | 28/72.6 |
| 3,247,020 | 4/1966 | Shulver et al. | 117/126 GM |
| 3,268,312 | 8/1966 | Grant | 117/126 GM |
| 3,365,346 | 1/1968 | Fritz et al. | 117/111 R |
| 3,411,942 | 11/1968 | Fritz et al. | 427/175 X |
| 3,672,947 | 6/1972 | Luscher et al. | 117/126 R |
| 3,687,712 | 8/1972 | Hartmann | 117/68 |

*Primary Examiner*—Michael R. Lusignan
*Assistant Examiner*—Evan K. Lawrence
*Attorney, Agent, or Firm*—Nolte and Nolte

[57] ABSTRACT

A liquid finish composition is applied to a plurality of continuous thermoplastic polymer filaments in such a way that the composition is applied to all the filaments uniformly from filament to filament. More particularly, the filaments are arranged side-by-side in a substantially planar array, at a first location one face of the array is contacted with the liquid finish composition and, then, at a second location spaced apart from the first location the other face of the array is contacted with the same composition. During the contacting at the first and second locations the tension is controlled so that it is in a range in which the contacting applies the composition to the filaments uniformly from filament to filament.

11 Claims, 3 Drawing Figures

METHOD OF APPLYING LIQUID FINISH COMPOSITION TO FILAMENTS

This is a continuation of application Ser. No. 276,617, filed July 31, 1972 now abandoned.

This invention relates to a method of applying a liquid finish composition to a plurality of continuous filaments.

Thermoplastics are extruded into a plurality of continuous filaments to make one or more yarns. It is frequently desired to texturize, such as by crimping, the continuous filaments in order to impart thereto increased bulk or a pleasing "hand", i.e., aesthetic tactile characteristics. Preliminary to the crimping of the filaments, it is necessary to apply thereto a liquid finish composition. The function of this composition is to lubricate the surfaces of the filaments so that the filaments are crimped efficiently and without being damaged. Uniform application of the finish to the filaments is very important since non-uniformity of the finish on the filaments results in sharp variations in the crimping which adversely affect the appearance of the yarn. In simultaneously applying finish to a plurality of continuous filaments, a particular problem is lack of uniformity of application of finish from filament to filament. To the solving of this problem the present invention is particularly directed. The objects of the invention also include uniform filament to filament application of finish to facilitate other handling and processing of the filaments and multifilament yarns, such as winding and drawing.

According to the invention, the plurality of continuous filaments is arranged side-by-side in a substantially planar array preparatory to the application of the finish thereto and, then, the finish is applied to both faces of the array. Application of the finish to each face of the array is preferably by means of a respective doctor roller. Each such roller is arranged partly immersed in a trough containing the finish composition. A motor drives the roller in the direction in which the filaments are being advanced. The array of filaments passes in contact with the surface of the roller whereby finish which has been picked up onto the roller surface from the trough is applied onto the filaments.

Preferably, the filaments are positively driven at a first position before the filaments reach the rollers and at a second position after the filaments have passed in contact with the rollers and the tension on the filaments between the two positions is maintained at a desired value by controlling the relative speeds at the two positions. The surface of each roller where the roller contacts a face of the array and the positions at either side of the rollers at which the filaments are engaged by means for feeding and withdrawing the filaments from the roller surfaces preferably is slightly offset from tangential so that the filaments make firm contact with the roller surface and contact a small area of the roller surface rather than merely a line thereon parallel to the axis thereof. Also, it is found that particularly improved results are obtained if the tension on the filaments during the contacting thereof with the roller surfaces is maintained within predetermined limits, preferably from about 0.08 to about 0.10 gram per denier.

It is found that the method of the present invention is particularly useful for the application of finish to extruded filaments which have not yet been either drawn or texturized, particularly crimped. It is found that especially good results are attained when undrawn, untexturized filaments to which finish has been applied according to the invention are drawn and texturized on a draw-texturizer wherein the texturizing is by stuffer box crimping, particularly such machine as is illustrated in U.S. Pat. No. 3,454,998. Subsequent to the application of the finish and preliminary to the draw-texturizing, the filaments are guided together to form one or more bundles, i.e., one or more discrete multifilament yarns. These yarns may then be wound to form packages from which the yarns are subsequently fed through the draw-texturizer machines or the yarns may be fed, without intermediate winding, directly to the draw-texturizing machines.

In a particular process in which the method of the invention has been used to great advantage, a thermoplastic polymer is extruded through a spinerette in the form of a substantial plurality of continuous filaments into an aqueous quench bath, the filaments are withdrawn from the quench bath and excess quench liquid is removed therefrom by wiping and vacuum stripping, whereafter liquid finish is applied to the filaments by the method of the invention, then the filaments are segregated to form two or a few multifilament yarns, each yarn is wound to form a package, and the packages are then mounted on draw-texturizing machines of the type described in U.S. Pat. No. 3,454,998 whereon the yarns are drawn and stuffer box crimped. The resultant yarns may then be used to form fabrics, knit garments, the pile of carpeting or whatever other intermediate or final products which may be formed from such yarns. In this particular process, pigment pellets are fed to the extruder with pellets of the thermoplastic polymer, whereby coloration of the filaments is attained by the so-called "spin dyeing" method. However, alternatively, the yarns or resultant goods may be dyed by other methods.

For the production of heavy denier yarns, such as for carpeting, it is preferred to feed two or a few of the yarns simultaneously through a given draw-texturizing machine. This simultaneous processing of a plurality of the yarns effectively combines the yarns into a single heavier denier yarn. It will be appreciated that the larger the number of filaments and yarns combined, the more critical becomes the matter of end-to-end uniformity of finish application since the statistical probability of the presence of filaments with a higher or lower than average finish level becomes ever greater with the increasing number of filaments combined in the final yarn. The filaments having a lower or higher than average level of finish may appear in the fabric or other goods as a streak or other irregularity.

It is important to keep in mind that what the present invention achieves is end-to-end uniformity of finish application, end-to-end meaning from filament to filament. ("End" is a term of art meaning a respective filament or yarn being processed.) In this respect, one would not anticipate that there would be any difference between doctoring the finish onto one face of the array of filaments or doctoring the finish onto both faces. It has been conventional to apply finish to only one side of a yarn or array of filaments, relying upon the capillary action of the interstices between the filaments to distribute the finish. This technique, in fact, suffices to distribute finish onto all surfaces of the filaments. The present invention, however, is directed to obtaining greater uniformity from filament to filament. In this respect, it would not be anticipated that application of the finish to both sides of the array rather than to one side would make a substantial difference.

The invention will now be further described by reference to the drawings, in which.

Figure 3:
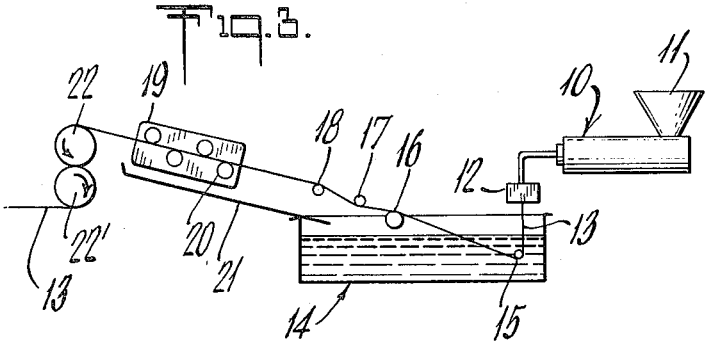
FIG. 3 is a side elevation of apparatus employed in conjunction with the apparatus of FIG. 1.

Into an extruder 10 through hopper 11 are fed thermoplastic and pigment pellets. The resultant mixture, in molten form, is extruded through spinerette 12 in the form of a plurality of continuous filaments 13 into aqueous liquid-containing quench tank 14 (FIG. 3).

A guide bar or plural guide bar assembly 15 receives the freshly extruded filaments and distributes them across a portion of the breadth of the tank. Therefrom the filaments pass to an assembly of wiper and tension bars 16, 17 and 18 by means of which liquid from the bath is wiped from the filaments and the filaments are firmly arranged in a planar side-by-side array. The planar array of filaments then passes through a vacuum stripper assembly 19 where bars 20 provided with slots (not illustrated) through which suction is applied, strip residual moisture from the filaments. Moisture which drips from the filaments is returned to the tank by means of an inclined tray 21.

Figure 1:
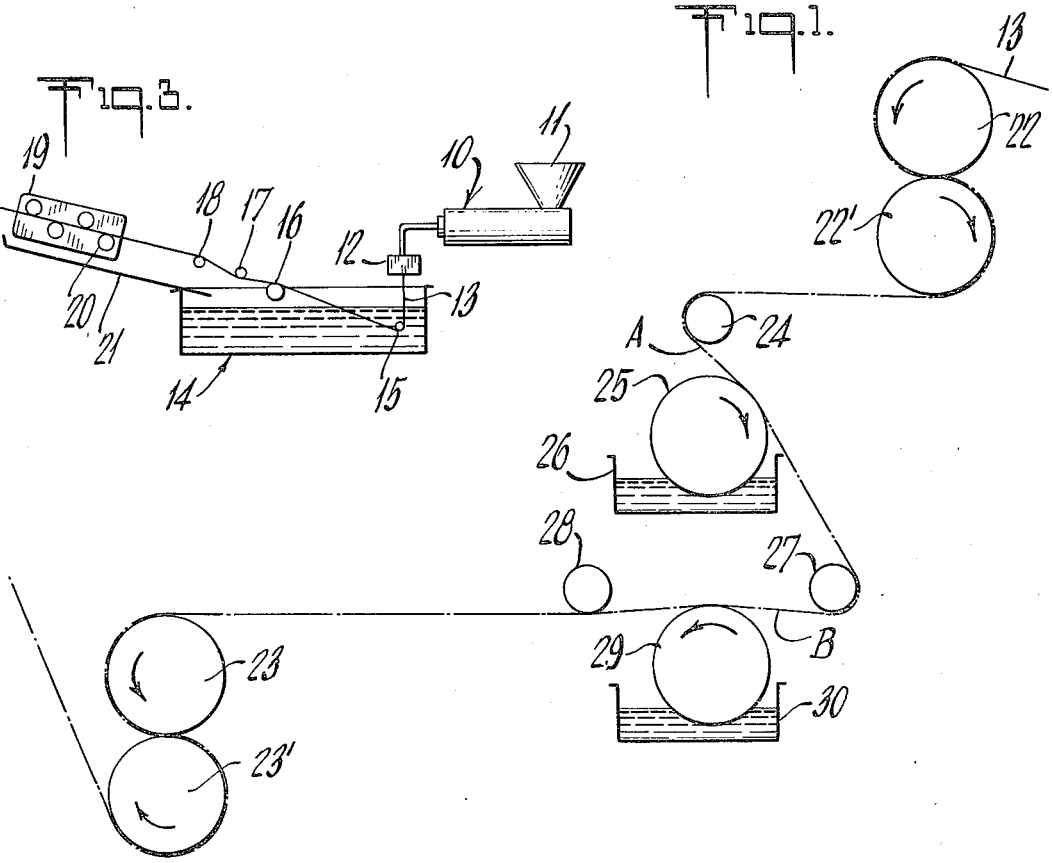
FIG. 1 is a side elevation of an apparatus suitable for carrying out the method of the invention.
Figure 2:
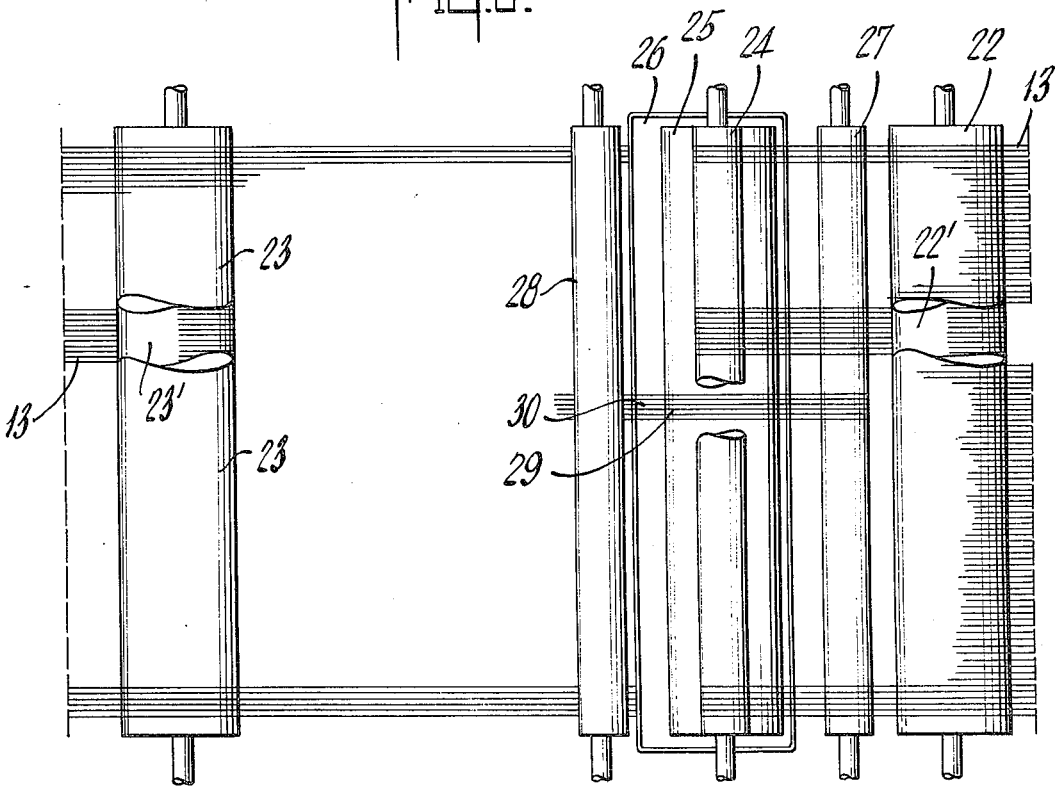
FIG. 2 is a plan view of the apparatus of FIG. 1.

The planar array of filaments then passes on to the portion of the apparatus where application of the finish is effected (FIGS. 1 and 2). The planar array of filaments is fed to that portion of the apparatus by means of a pair of driven rolls 22, 22' and is withdrawn from that portion of the apparatus by means of a pair of driven rolls 23, 23' as shown in FIGS. 1 and 2. The rolls 22, 22' also serve to pull the filaments through the preceding portion of the apparatus.

The parallel array of filaments 13 passes over the roll 22, then between the nip of the rolls 22, 22' and then under the roll 22' to a non-driven guide roller 24 (FIGS. 1, 2). A doctor roller 25 is suspended over a trough 26 containing a liquid finish composition with the lower portion of the roller 25 immersed in the liquid. The roller 25 is driven clockwise (as viewed in FIG. 1) at a slower speed than the speed of the rolls 22, 22' and 23, 23'. A non-driven quide roller 27 acts with the guide roller 24 to pass the planar array of filaments 13 across the surface of the roller 25 in a slightly non-linear, non-tangential path so that there is firm contact between the filaments and the surface of the roller 25 and the contact is over a small arcuate portion of the surface of the roller 25. The roller 25 picks up the liquid finish composition from the trough 26 and applies it to face A of the planar array of filaments 13.

Below the roller 25 and trough 26 are provided an identical roller 29 and trough 30 with an additional quantity of the finish liquid contained in the trough 30 and the lower portion of the roller 29 immersed therein. A non-driven guide roller 28 is positioned at the far side of the roller 29-trough 30 combination to cooperate with the roller 27 in the same manner that the roller 24 cooperates with the roller 27. Specifically, the roller 28 together with the roller 27 guide the planar array of filaments 13 across a small arcuate portion of the surface of the roller 29 in a slightly non-linear, non-tangential path. The roller 29 is driven counterclockwise at a speed less than the speed of the rollers 22, 22' and 23, 23'. The roller 29 picks up the liquid finish composition from the trough 30 and applies that composition to the other face B of the planar array of filaments 13. The speed of the rollers 23, 23' relative to the speed of the rollers 22, 22' is regulated to maintain constant tension on the filaments in the range of 0.08 to 0.10 gram/denier as the filaments pass in contact with the rollers 25 and 29. Subsequent processing, as mentioned hereinabove, is then effected.

Liquid finishes themselves for synthetic filaments are well known and do not constitute part of the present invention. For example, for polypropylene there may be employed an aqueous emulsion of a polyethylene glycol ester and for nylon-6,6 there may be employed an aqueous emulsion of mineral oil.

In a specific example according to the invention, to 18-filament polypropylene, polypropylene being particularly difficult to apply finish to uniformly by prior art methods, of total denier 2010 is applied an aqueous emulsion of polyethylene glycol ester while the filaments are under a total tension of 175 grams. Filament to filament variation in the amount of finish taken up is a remarkably low less than 10%. These results are found to be reproducible upon repeated runs. In other words, with an average finish takeup of, for example, 1% by weight, based on the weight of the dry filaments, each filament will be found to carry more than 0.9% and less than 1.1% of finish.

The specific embodiments with reference to which the present invention has been described are intended as illustrative rather than limitative of the invention, the scope of which is to be determined by reference to the appended claims.

What is claimed is:

1. In the processing of continuous thermoplastic polymer filaments to make textile yarns therefrom, a method of applying a liquid finish composition to a plurality of continuous thermoplastic polymer filaments, the liquid finish composition having the function of facilitating subsequent mechanical handling and processing of the filaments, comprising arranging the filaments side-by-side in a substantially planar array, driving said array with a first driving surface before contacting the filaments with the finish composition, said driving surface moving at a first peripheral speed in the direction of movement of the array, contacting one face of the array with the peripheral surface of a first roller carrying an applied finish composition at a first location, then contacting the other face of the array with the peripheral surface of a second roller carrying the same finish composition at a second location spaced apart and downstream of said first location, while driving said first and second rollers at a peripheral speed in the direction of the movement of the array slower than the peripheral speed of said first driving surface, and then driving the array with a second driving surface moving at a peripheral speed in the direction of the movement of the array faster than the first driving surface so as to control the filaments at a tension within a range selected, so that upon contacting the array with said first and second rollers, the finish is applied to all the filaments uniformly from filament to filament.

2. A method according to claim 1, in which the thermoplastic polymer is polypropylene.

3. A method according to claim 1, in which said tension range is about 0.08 to 0.10 gram per denier.

4. A method according to claim 1, in which said tension range is about 0.08 to about 0.10 gram per denier.

5. A method according to claim 1, in which the filaments to which the liquid finish composition is applied are undrawn and untexturized.

6. A method according to claim 5, in which the thermoplastic is polypropylene.

7. A method according to claim 6, in which said tension range is about 0.08 to about 0.10 gram per denier.

8. A method according to claim 1, in which the filaments to which the liquid finish composition is applied are undrawn.

9. A method according to claim 1, in which the liquid finish composition is a lubricant for the filaments.

10. A method according to claim 3, in which the thermoplastic polymer is polypropylene.

11. A method according to claim 4, in which the thermoplastic polymer is polypropylene.

* * * * *